United States Patent [19]

Canada

[11] Patent Number: 4,875,792

[45] Date of Patent: Oct. 24, 1989

[54] BRUSH DEVICE CONTAINING CARRIER MEDIA

[75] Inventor: Larry J. Canada, Granite City, Ill.

[73] Assignee: Sekine Corporation, New York, N.Y.

[21] Appl. No.: 85,759

[22] Filed: Aug. 17, 1987

[51] Int. Cl.[4] ..... A45D 20/52; A46B 11/04

[52] U.S. Cl. ..... 401/283; 401/28; 132/221

[58] Field of Search ..... 401/283, 28; 132/112–116, 9, 85, 120, 207, 212, 221; 15/160, 159 A, 159 R; 34/96; 16/116 R

[56] References Cited

U.S. PATENT DOCUMENTS

| | | | |
|---|---|---|---|
| 1,159,789 | 11/1915 | North et al. | 132/112 |
| 1,235,404 | 7/1917 | Wehrsen | 132/112 |
| 2,144,474 | 1/1939 | Woodman | 16/116 R |
| 2,299,296 | 10/1942 | Battle | 132/120 |
| 2,827,060 | 3/1958 | Marty | 132/9 |
| 3,346,901 | 10/1967 | Fay | 15/160 |
| 4,030,158 | 6/1977 | Blair et al. | 15/159 A |
| 4,230,279 | 10/1980 | Forsberg | 34/96 X |
| 4,376,441 | 3/1983 | Duncan | 132/112 X |

FOREIGN PATENT DOCUMENTS

| | | | |
|---|---|---|---|
| 0168741 | 6/1980 | European Pat. Off. | 132/112 |
| 650194 | 2/1951 | United Kingdom | 132/116 |
| 2035138 | 6/1980 | United Kingdom | 401/143 |

*Primary Examiner*—Richard J. Apley
*Assistant Examiner*—Franklin L. Gubernick
*Attorney, Agent, or Firm*—Martin Smolowitz

[57] ABSTRACT

A brush device adapted for grooming hair while distributing a substance to the hair or to a fabric while brushing, usually in a heated air environment. The brush body portion has an elongated cavity receiving a removable absorbent structure, which contains a grooming substance to be distributed such as in a vaporizable waxy semi-solid carrier material. The brush has a plurality of spaced transverse openings extending between the elongated cavity outwardly to the surface of the body and through which the vaporizable substance is distributed to the hair. Adjacent rows of bristles are provided firmly attached to the brush lower side in a zig-zag pattern between the spaced openings therein to facilitate lateral movement of hair strands during treatment. The distribution of the vaporizable substance from the brush cavity can be enhanced by heating the brush by using it in combination with a hot air hairdryer.

10 Claims, 1 Drawing Sheet

FIG. 1
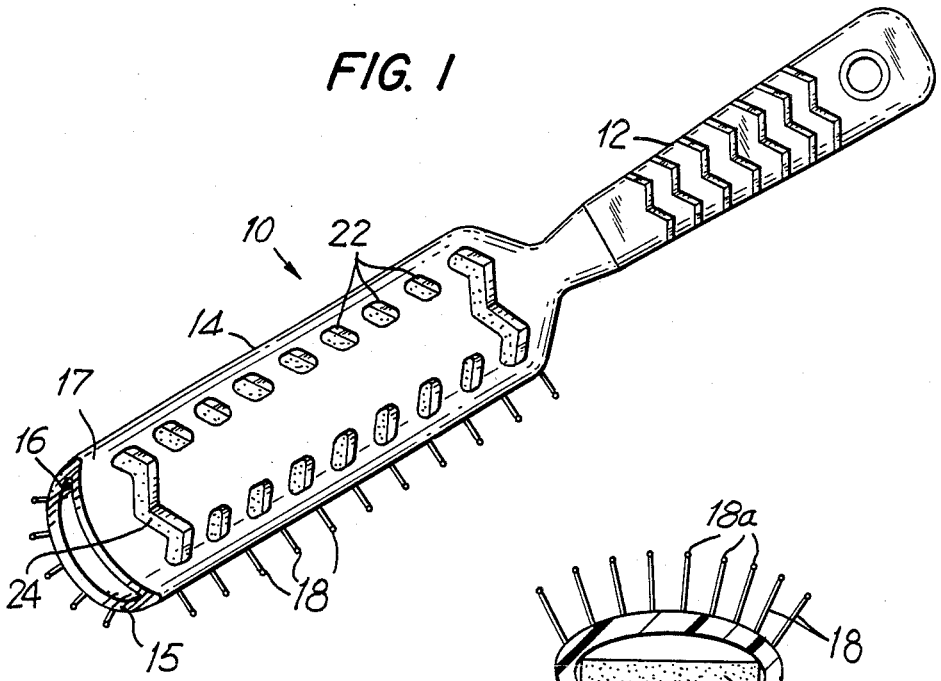
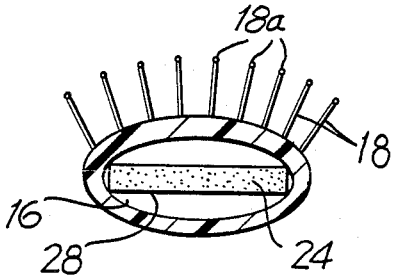
FIG. 3
FIG. 2
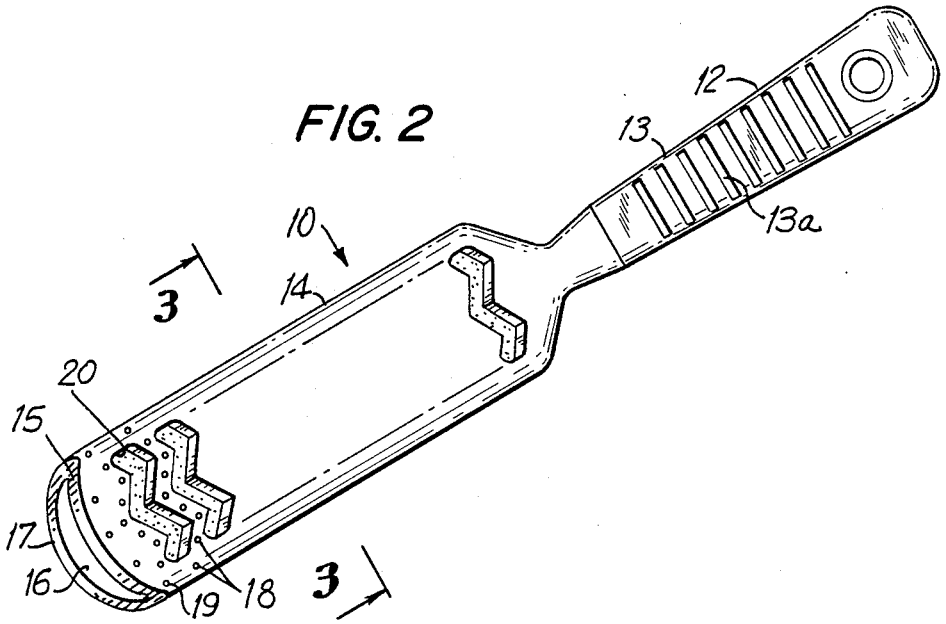

BRUSH DEVICE CONTAINING CARRIER MEDIA

BACKGROUND OF INVENTION

This invention relates to a brush device adapted for dispensing a treatment substance during brush usage. It particularly relates to a hair brush having an apertured body portion with a cavity therein containing an absorbent structure and treatment substance to be dispensed during use to treat the hair of a user.

Many times in the grooming or treating of the hair, substances are dispensed into or otherwise applied to the hair for various purposes. Combs and hairbrushes are known that include means for dispensing such substances in a liquid or solid carrier during the combing or brushing operations. For example, U.S. Pat. No. 2,336,717 to Crimmins discloses a hair treating device having an elongated channel provided in the body for receiving a removable container filled with a fluid for treating the hair and scalp. U.S. Pat. No. 2,952,027 to Caldwell discloses a dispensing brush with a chamber containing a porous material impregnated with a treatment substance. U.S. Pat. No. 3,908,679 to Wright discloses a brush for grooming hair which provides a layer of conditioning material adjacent the base of the bristles to interact with the hair during brushing. U.S. Pat. No. 4,030,158 to Blair et al discloses a hair brush having a plurality of apertures therein and adapted for blow waving of hair but without providing a conditioning material. Also, U.S. Pat. No. 4,076,032 to Misercola discloses a vented hair brush intended for use in cooperation with a hot air blow dryer.

Other prior art brush constructions which have been considered of general interest to show the state of the art are disclosed in U.S. Pat. Nos. 1,159,789; 1,235,404; and 3,843,990.

These known prior art brushes each have various deficiencies in use. Although some brush designs are arranged to provide a grooming material for the hair, the means usually provided for transferring the grooming material to the hair and/or scalp is ineffective. Other brush designs such as those described by U.S. Pat. Nos. 4,030,158 and 4,076,032 are designed to facilitate their use with a hot air hair dryer for styling, but they do not dispense any grooming or treatment material to the hair and scalp. However, these deficiencies in prior art brushes have now been advantageously overcome by the present invention.

SUMMARY OF THE INVENTION

It is a principal object of the present invention to provide a brush device adapted not only for grooming hair and treating the scalp, but which also dispenses a treatment substance to the hair or other places in a simple and efficient manner.

It is also an object of the invention to provide a brush having an apertured body portion which contains and automatically dispenses a treatment substance such as contained in a wax or wax-like carrier material, particularly when used in a heated air environment. It is another object of the invention to provide an absorbent structure containing a waxy carrier material for grooming and treatment substances to be applied to hair using a brush, which material can be replenished in the brush conveniently and easily.

It is still another object of the invention to provide a method for grooming hair while simultaneously dispensing a substance conveniently and easily from a brush containing such substance to the hair and scalp of a user.

These and other object and advantages of the present invention will become apparent from the following description.

The brush device of the present invention includes a handle portion and a body portion integrally attached thereto, the body portion having an elongated cavity centrally located therein and open only at the brush forward end. The brush body portion has upper and lower arcuate curved surfaces, and has a plurality of spaced openings provided on its upper side together with a corresponding number of spaced elongated openings provided on its lower side and extending transversely across the curved body portion. A plurality of bristle elements or tufts are firmly attached to the body lower side portion in rows between the spaced transversed openings. The bristles in each row are provided in an alternating or zig-zag alignment pattern, so as to facilitate lateral movement of hair strands during brushing and grooming use. The brush body is made of a strong dimensionally stable material such as molded plastic which is smooth and provides sufficient stiffness and resistance to heat during normal use. The bristle elements are also each made of a material which is resilient and resistant to temperatures up to about 200° F. during use. Each bristle preferably has a ball or knob portion on the outer end to avoid scratching the scalp during use of the brush.

The elongated cavity in the brush body portion is coextensive with the body portion and adapted for receiving an elongated absorbent structure inserted into the cavity through its open end. The absorbent structure contains a substance selected for treatment of the hair and scalp of the user which substance is vaporizable at temperature between about 70°–180° F. The substance is usually mixed with a waxy semi-solid material that acts as a carrier for a hair conditioner, a shampoo, a hair coloring, a fragrance, a deodorizer or some ther like substance. Evaporation of the substance from the absorbent structure is facilitated by air currents generated during movement of the brush and which pass through the spaced openings therein, while the hair strands are moved laterally back and forth by the brush bristles in each row being aligned in a zig-zag arrangement. Such evaporation of the treatment substance may be further facilitated by application of a stream of heated air contacting the brush and hair, such as from a blow type hair dryer operating at 100°–180° F. air temperature.

The invention also advantageously provides a method for grooming hair while simultaneously dispensing a treatment substance from the brush to the hair and scalp, usually with the aid of a hot air blow dryer held adjacent to the brush to facilitate evaporation of the grooming substance.

BRIEF DESCRIPTION OF DRAWINGS

This invention will be further described with reference to the following drawings, in which:

FIG. 1 shows a perspective view of the upper side of one embodiment of a brush device constructed according to the present invention;

FIG. 2 is a perspective view showing the lower side of the brush constructed according to the invention and showing the bristle transverse rows attached to the brush; and FIG. 3 is a cross-sectional view of the brush body portion taken at section 3-3' of FIG. 2 showing the cavity and absorbent structure inserted therein.

DESCRIPTION OF INVENTION

As shown in the FIG. 1 and 2 drawings, reference number 10 refers to a brush device constructed according to the present invention. The brush 10 includes a handle portion 12, and a hollow body portion 14 integrally connected together. The handle portion 12 is usually covered by a flexible sleeve 13 containing multiple transverse grooves 13*a* to facilitate hand gripping the brush by a user.

The body portion 14 has an elongated cavity 16 centrally located therein, the cavity extending the length of the body portion. A plurality of bristles or tufts 18 extends from the body portion 14 lower side 15 in a plurality of spaced groups or rows 19 that extend transversely across the hollow body portion 14. A preferred arrangement of the groups of bristles 18 extending from the brush body portion 14 lower side 15 is shown in FIG. 2, with the bristles in each row having a zig-zag arrangement or pattern. Located between the adjacent transverse rows 19 of bristles are spaced slots 20 which each also have a wavy or zig-zag shape.

As is shown by FIG. 1, the upper side 17 of the brush body portion 14 has a plurality of openings 22 located in substantial vertical alignment with the wave-shaped slots 20 provided between the rows of tufts 18 in the bottom side of the brush, but are provided only along the sides of the body portion. The bristles have small knobs 18*a* provided on their outer ends to prevent scratching the scalp during use. The bristles are made of a heat resistant plastic material such as conventional materials, which will remain stiff and resilient even after prolonged exposure to heated air at 100°-180° F. temperature.

The brush body 14 elonaged cavity 16 preferably has a cross-sectional shape similar to that of the brush body portion. The wall thickness of the body portion lower side 15 is made sufficient, such as about 0.120-0.130 inch, to retain the bristles 18 which each usually have folded ends inserted into a hole therein. The upper wall 17 of body portion 14 can be made somewhat thinner than lower wall 15, such as about 0.010 inch, as there is no need to rigidly retain any bristles therein. The brush handle and body portions are made of a strong yet lightweight material such as a structural plastic material.

Provided within elongated cavity 16 is an absorbent structure 24 which is selected for effectively retaining a vaporizable treatment substance 26 therein. The substance 26 can be formulated to be sufficiently vaporizable at ambient temperature of 70°-80° F. with the benefit of air currents and movement generated by the air brushing action. Alternatively, the substance 26 can be formulated to be vaporizable with the benefit of heat added by an air blow dryer which emits an air stream at 100°-180° F. temperature held adjacent the brush during its use in grooming the hair.

As a result of each row 19 of the bristles 18 having a wavy or zig-zag shape, during brushing the hair strands are advantageously moved laterally back and forth so as to expose the hair more completely and effectively to the grooming substance being emitted from absorbant structure 24. Furthermore, the openings 22 in the upper side 17 of the brush body 14 have a smaller total cross-sectional area than the openings 20 in the brush lower side 15, in order to selectively direct the flow of evaporated grooming material toward the hair being groomed. Preferably the total area of upper openings 22 is only about 30°-70° of the total area of the lower openings 20. This relative area configuration for openings 20 and 22 also facilitates effective use of the brush in combination with a hot air hair dryer hand held near the brush during use.

A preferred material for the wax or wax-like carrier is one which changes from a waxy semi-solid form to less solid or even to liquid or vapor form in the presence of heat such as the temperature produced by hand held hairdryers. Such devices usually heat the carrier to a temperature of about 100°-180° F. One carrier material which has been successfully tested is that used in a commercially available product known as Revlon Flex Balsam and Protein Instant Hair Conditioner (Extra Body) produced by Revlon, Inc., New York, N.Y., 10022. When this product is reconstituted in stick form, some of the water and alcohol contained in it is evaporated off until the product reaches a desired consistency for use with the present hair brush. Typical ingredients of the carrier and of the treatment substance to be distributed include water, stearalkonium chloride, hydrolyzed animal protein, balsam canada, cetyl alcohol, cetearyl alcohol, polysorbate 60, peg-150 stearate, steareth-20, propylparaben, methylparaben, citric acid, quaternium-15, DMDM hydantoin, F D & C yellow #5, and D & C green #5. Other typical ingredients such as fragrances, hair dyes, hair cleansers and deodorants as well as other wax or wax-like semi-solid base material having the desired heat flowable and vaporizable characteristics may be included or substituted by those skilled in the art.

Other shapes for the hairbrush 10 can also be used rather than the oval cross-sectional shape shown in FIGS. 1-3. For instance, a hairbrush having a round or a rectangular shape and having different arrangements of the bristles can also be used as long as it is constructed to accommodate the absorbhent structure containing a waxy carrier material as described herein.

This invention also discloses a method for grooming hair while simultaneously dispensing a treatment substance to the hair or scalp of the user. The method includes the steps of placing in an absorbent structure a grooming material or substance to be dispensed and inserting the absorbent structure into a cavity within an apertured body portion of a brush, so that the absorbent structure and grooming material are exposed to movement of ambient air during use, and the grooming material is evaporated and released through the openings during motion of the brush. The release of the grooming material is greatly facilitated by use of the brush in combination with a hand held air blow dryer which emits a heated air stream at 100°-180° F. and is held adjacent the brush during use.

There has been shown and described several embodiments of a dispensing implement hair brush, a dispensing substance, and a method for use all of which fulfill the objects and advantages sought therefor. However, it will be apparent that many modifications, variations, and other uses and applications of the subject device are possible all within the spirit and scope of the invention which is defined by the following claims.

What is claimed is:

1. A brush for grooming hair and dispensing a treatment substance contained in a carrier material provided therein, the brush comprising:

a handle portion and a body portion integrally attached to the handle portion, said body portion having an elongated cavity formed therein which is permanently closed at a rear end of said cavity adjacent the handle portion, said cavity being coextensive with the body portion and adapted for receiving an absorbent structure, said body portion having an upper and a lower side and a plurality of spaced transverse openings extending through the upper and lower sides of the body portion between the cavity and the surrounding ambient air;

a plurality of bristles attached at spaced locations to the body portion lower side between said transverse openings, said bristles being provided in spaced transverse rows having a zig-zag alignment pattern substantially conforming to the body portion shape between said openings to facilitate lateral movement of hair strands while being groomed; and an elongated absorbent structure removably provided within said elongated cavity in at least the body portion, said absorbent structure containing a treatment substance vaporizable at 70°-180° F. temperature, whereby the treatment substance contained in the elongated absorbent structure can evaporate and effectively contact the hair while strands of hair are moved laterally back and forth by the bristles during use of the brush for grooming the hair.

2. The brush of claim 1, wherein said body portion upper side wall is made thinner than the body portion lower wall, said bristles having folded ends inserted into holes in said lower wall.

3. The brush of claim 1, wherein said absorbent structure provided in the body cavity contains a wax-like carrier material for the treatment substance, said carrier material being selected to evaporate at ambient temperature conditions.

4. The brush of claim 1, wherein said body portion has an open forward end and said plurality of spaced openings on its upper side, are in substantial vertical alignment with said transverse openings provided on the body portion lower side.

5. The brush of claim 4, wherein said body portion has upper and lower arcuate curved surfaces and the upper side openings have smaller total open area than the lower side openings.

6. The brush of claim 5, wherein the total area of the body portion upper side openings is 30–70% of the total area of the body portion lower side openings.

7. A brush for grooming hair and simultaneously dispensing a treatment substance contained in a carrier material provided therein, the brush comprising:

a handle portion and a body portion integrally attached to the handle portion, said body portion having an open forward end and an elongated cavity formed therein co-extensive with the body portion and adapted for receiving an absorbent structure, said body portion having an upper and a lower side and a plurality of spaced transverse openings extending through the body portion lower side wall between the cavity and the surrounding ambient air;

a plurality of bristles attached at spaced locations to the body portion lower side between said transverse openings, said bristles being arranged in spaced transverse rows having a zig-zag pattern substantially conforming to the body portion shape between the transverse openings to facilitate lateral movement of the hair while being groomed;

a plurality of spaced openings provided in the body portion upper side in substantial vertical alignment with said lower transverse openings, said upper openings having a smaller total area than the total area of the lower openings; and an absorbent structure containing a treatment substance removably provided within said elongated cavity in the body portion, said treatment substance being selected to evaporate at 70°-180° F. temperature, whereby the treatment substance contained in the absorbent structure can evaporate and effectively contact the hair while strands of the hair are moved laterally back and forth by the bristles during use of the brush for grooming the hair.

8. A method for grooming hair and simultaneously dispensing a treatment substance to the hair, comprising:

providing a brush including a handle portion and a body portion having an elongated cavity having upper and lower sides and being within the body portion only and having a plurality of spaced openings in said upper and lower sides of said body portion communicating the cavity with the surrounding ambient air, said lower side openings having a larger total area than said upper side openings said body portion having multiple spaced transverse rows of bristles attached to the body portion lower side and arranged in a zig-zag pattern;

incorporating a treatment substance to be dispensed in an absorbent structure which releases the substance when exposed to ventilation air;

placing the absorbent structure and treatment substance in the body cavity; and brushing hair fibers with the brush in an environment so that the motion of the brush moves the hair strands laterally back and forth while releasing the treatment substance contained in the absorbent structure and effectively treating the hair, whereby the treatment substance is evaporated from the absorbent structure within the cavity and passes preferentially through larger area openings provided in the body lower side and contacts the hair being groomed and treated.

9. The method of claim 8, including providing a source of air flow heated to 100°-180° F. adjacent the brush body portion to facilitate evaporation of the treatment substance from the absorbent structure to the hair being treated.

10. A method for grooming hair and simultaneously dispensing a treatment substance to the hair, comprising:

providing a brush including a handle portion and a body portion having an elongated cavity within the body portion only, and having a plurality of spaced openings extending through upper and lower sides of the body portion communicating between the cavity and surrounding ambient air, said lower side openings having a larger total area than said upper side openings. said body portion having multiple spaced transverse rows of bristles attached to the body portion lower side and arranged in a zig-zag pattern;

incorporating a treatment substance to be dispensed in an absorbent structure containing a wax-like carrier material which releases the treatment substance when exposed to flowing heated air;

placing the absorbent structure containing a wax-like carrier material and a treatment substance in the body cavity;

providing a source of flowing air heated to 100°–180° F. temperature adjacent the brush body portion arranged to introduce the heated air through the spaced openings in the brush cavity; and introducing hot air therein to soften the wax-like carrier material sufficiently to evaporate the treatment substance from the absorbent structure, so as to preferentially pass through the spaced larger area opening provided in the body portion lower side and contact the hair being groomed and treated.

* * * * *